US006678923B2

(12) United States Patent
Goldberg et al.

(10) Patent No.: US 6,678,923 B2
(45) Date of Patent: Jan. 20, 2004

(54) BAG CLOSURE SYSTEM

(75) Inventors: Mark H. Goldberg, Paradise Valley, AZ (US); Robert L. Coker, Huntington Beach, CA (US); Douglas P. Gibbs, Yuba City, CA (US)

(73) Assignee: Bisadora, LLC., Paradise Valley, AZ (US)

( * ) Notice: Subject to any disclaimer, the term of this patent is extended or adjusted under 35 U.S.C. 154(b) by 0 days.

(21) Appl. No.: 10/190,791

(22) Filed: Jul. 3, 2002

(65) Prior Publication Data

US 2003/0009858 A1 Jan. 16, 2003

Related U.S. Application Data

(60) Provisional application No. 60/304,839, filed on Jul. 11, 2001.

(51) Int. Cl.[7] ..... B65D 33/28

(52) U.S. Cl. ..... 24/30.5 R; 24/30.5 P; 24/400; 24/462; 24/555; 24/30.5 S; 383/33; 383/89

(58) Field of Search ..... 24/30.5 R, 30.5 P, 24/555, 561, 563, 559, 520, 462, 543, 464, 30.5 S; 383/33, 43, 89

(56) References Cited

U.S. PATENT DOCUMENTS 2,158,955 A * 5/1939 Blacher ..... 24/30.5 R
2,822,012 A * 2/1958 Gold ..... 150/10
3,460,741 A * 8/1969 Kugler ..... 24/30.5 R
4,786,189 A * 11/1988 Broderick et al. ..... 383/75
4,832,507 A * 5/1989 Herrington ..... 383/74
5,006,380 A * 4/1991 Fraser ..... 383/75
5,140,727 A * 8/1992 Dais et al. ..... 24/400
5,722,128 A * 3/1998 Toney et al. ..... 24/400
6,022,144 A * 2/2000 Hausslein ..... 383/33
6,233,786 B1 * 5/2001 Lin ..... 24/30.5 R

* cited by examiner

*Primary Examiner*—Victor Sakran
(74) *Attorney, Agent, or Firm*—Michael S. Neustel

(57) ABSTRACT

A bag closure system for automatically closing a bag with audible and tactile feedback to indicate proper closure of the bag. The bag closure system includes a bag device having an opening, a first band positioned within a first lip of the opening, and a second band positioned within a second lip of the opening. The first band and second band are comprised of a resilient elongate material that audibly and tactilely indicate when the opening is opened or closed. The first band and the second band further provide for automatic closure of the opening to prevent loss of items within the bag device. The first band and the second band are preferably comprised of a resilient material having an arcuate cross section providing rigidity to the bands when in a straight condition.

20 Claims, 7 Drawing Sheets

BAG CLOSURE SYSTEM

CROSS REFERENCE TO RELATED APPLICATIONS

I hereby claim benefit under Title 35, United States Code, Section 119(e) of U.S. provisional patent application Ser. No. 60/304,839 filed Jul. 11, 2001. The 60/304,839 application is currently pending. The 60/304,839 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to bag devices and more specifically it relates to a bag closure system for automatically closing a bag with audible and tactile feedback to indicate proper closure of the bag.

2. Description of the Related Art

Bag closure devices have been in use for years. Conventional bag closure devices are typically comprised of magnets, buttons, toggles, drawstrings, hooks, hook and loop fasteners, zippers, snaps, flaps, covers and similar structures.

The main problem with conventional bag closure devices is that they are relatively large, particularly when utilized upon smaller bags. The relatively large size of the closure devices make handling of the bag difficult and depreciate the overall appearance of the bag. Conventional closure devices are also prone to becoming entangled with exterior objects or collecting undesirable debris.

Another problem with conventional bag closure devices is that they must be deliberately and physically closed by the user to avoid valuables within the bag from being exposed. The user must physically engage the magnets, buttons, drawstrings, hooks, snaps, hook and loop fastener, zippers, covers, flaps and other structures in order to properly close a bag.

A further problem with conventional bag closure devices is that they are susceptible to significant wearing over extended periods of usage. Conventional bag closure devices are typically sewn, glued, riveted or attached by various other mechanical means which can become loosened and/or removed after extended usage.

Another problem with conventional bag closure devices is that they do not typically provide an audible and tactile response to the user indicating proper closure of the bag. Attempts to properly close a conventional bag closure sometimes fail without the user's knowledge. Users of conventional bag closure devices often times must "double-check" the closing of the bag by attempting to open the bag without opening the closure.

While these devices may be suitable for the particular purpose to which they address, they are not as suitable for automatically closing a bag with audible and tactile feedback to indicate proper closure of the bag. Conventional bag closure devices are relatively large and require a user to intentionally close the devices.

In these respects, the bag closure system according to the present invention substantially departs from the conventional concepts and designs of the prior art, and in so doing provides an apparatus primarily developed for the purpose of automatically closing a bag with audible and tactile feedback to indicate proper closure of the bag.

BRIEF SUMMARY OF THE INVENTION

In view of the foregoing disadvantages inherent in the known types of bag closure devices now present in the prior art, the present invention provides a new bag closure system construction wherein the same can be utilized for automatically closing a bag with audible and tactile feedback to indicate proper closure of the bag.

The general purpose of the present invention, which will be described subsequently in greater detail, is to provide a new bag closure system that has many of the advantages of the bag closures mentioned heretofore and many novel features that result in a new bag closure system which is not anticipated, rendered obvious, suggested, or even implied by any of the prior art bag closure devices, either alone or in any combination thereof.

To attain this, the present invention generally comprises a bag device having an opening, a first band positioned within a first lip of the opening, and a second band positioned within a second lip of the opening. The first band and second band are comprised of a resilient elongate material that audibly and tactilely indicate when the opening is opened or closed. The first band and the second band further provide for automatic closure of the opening to prevent loss of items within the bag device. The first band and the second band are preferably comprised of a spring steel material having an arcuate cross section providing rigidity to the bands when in a straight condition.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a bag closure system that will overcome the shortcomings of the prior art devices.

A second object is to provide a bag closure system for automatically closing a bag with audible and tactile feedback to indicate proper closure of the bag.

Another object is to provide a closure system that may be utilized upon various sizes, styles and types of devices including but not limited to apparel, bags, luggage and other related items.

An additional object is to provide a bag closure system that does not require the usage of rivets, glue, fasteners or other fastening devices.

A further object is to provide a bag closure system that has an extended useful life.

Another object is to provide a bag closure system that reassures a user that a bag has been properly and securely closed.

Another object is to provide a bag closure system that makes an audible sound that alerts the user to the fact that an unauthorized access to the user's purse is occurring.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
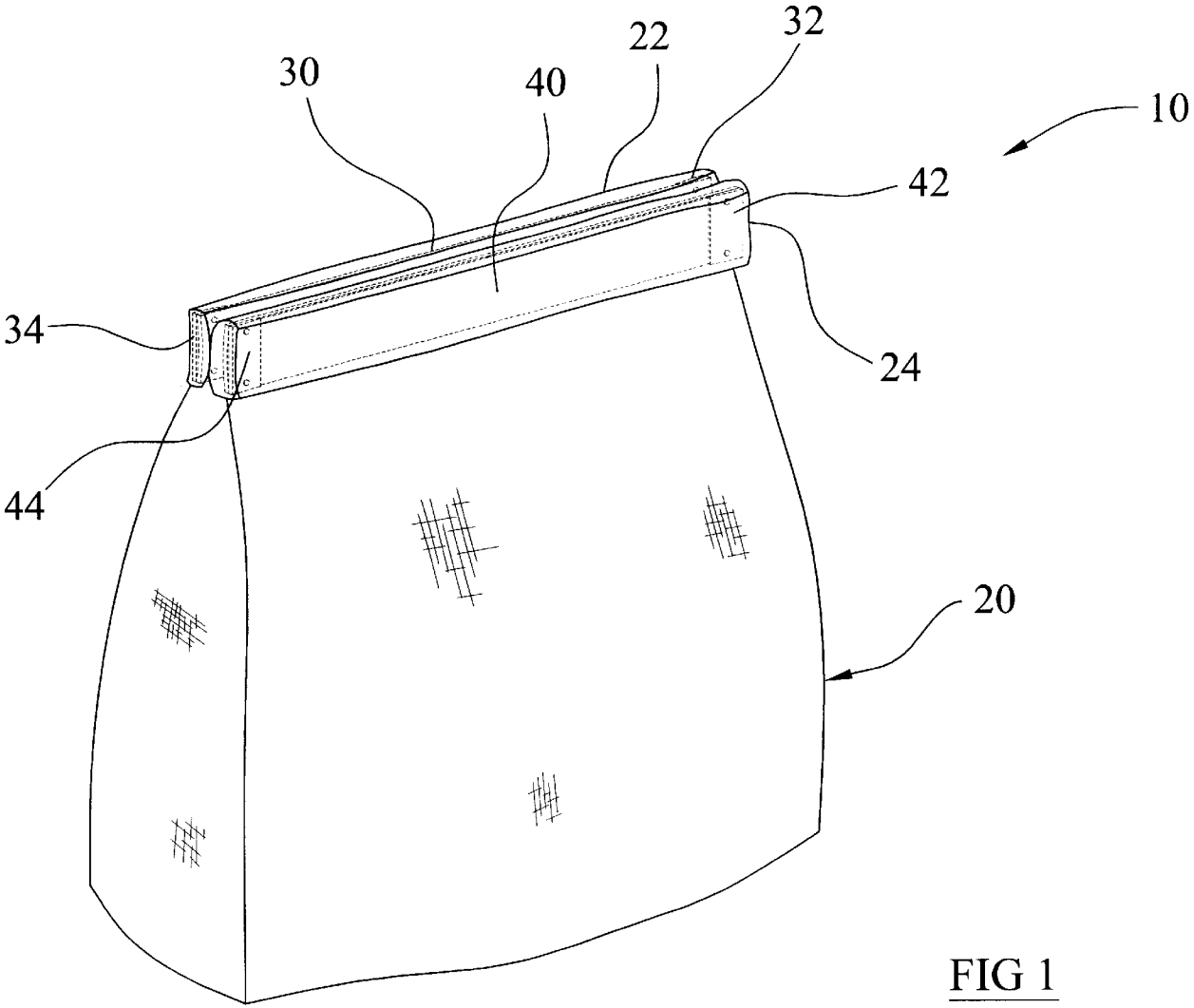
FIG. 1 is an upper perspective view of the present invention as embodied in an exemplary bag.

Turning now descriptively to the drawings, in which similar reference characters denote similar elements throughout the several views, FIGS. 1 through 7 illustrate a bag closure system 10, which comprises a bag device 20 having an opening, a first band 30 positioned within a first lip 22 of the opening, and a second band 40 positioned within a second lip 24 of the opening. The first band 30 and second band 40 are comprised of a resilient elongate material that audibly and tactilely indicate when the opening is opened or closed. The first band 30 and the second band 40 further provide for automatic closure of the opening to prevent loss of items within the bag device 20. The first band 30 and the second band 40 are preferably comprised of a spring steel material having an arcuate cross section providing rigidity to the bands 30, 40 when in a straight condition.

FIG. 1 illustrates the bag device 20 having an upper opening with a first lip 22 and a second lip 24 in opposition to one another. The bag device 20 may be comprised of various textiles, plastics and other suitable materials. The bag device 20 illustrated in the drawings is an exemplary bag utilized solely for illustration purposes. The bag device 20 may have various other structures and styles not illustrated within the drawings. In addition, the present invention may be embodied in various other related items such as but not limited to apparel, luggage, backpacks, knapsacks, purses, handbags, pouches and the like.

Figure 7:
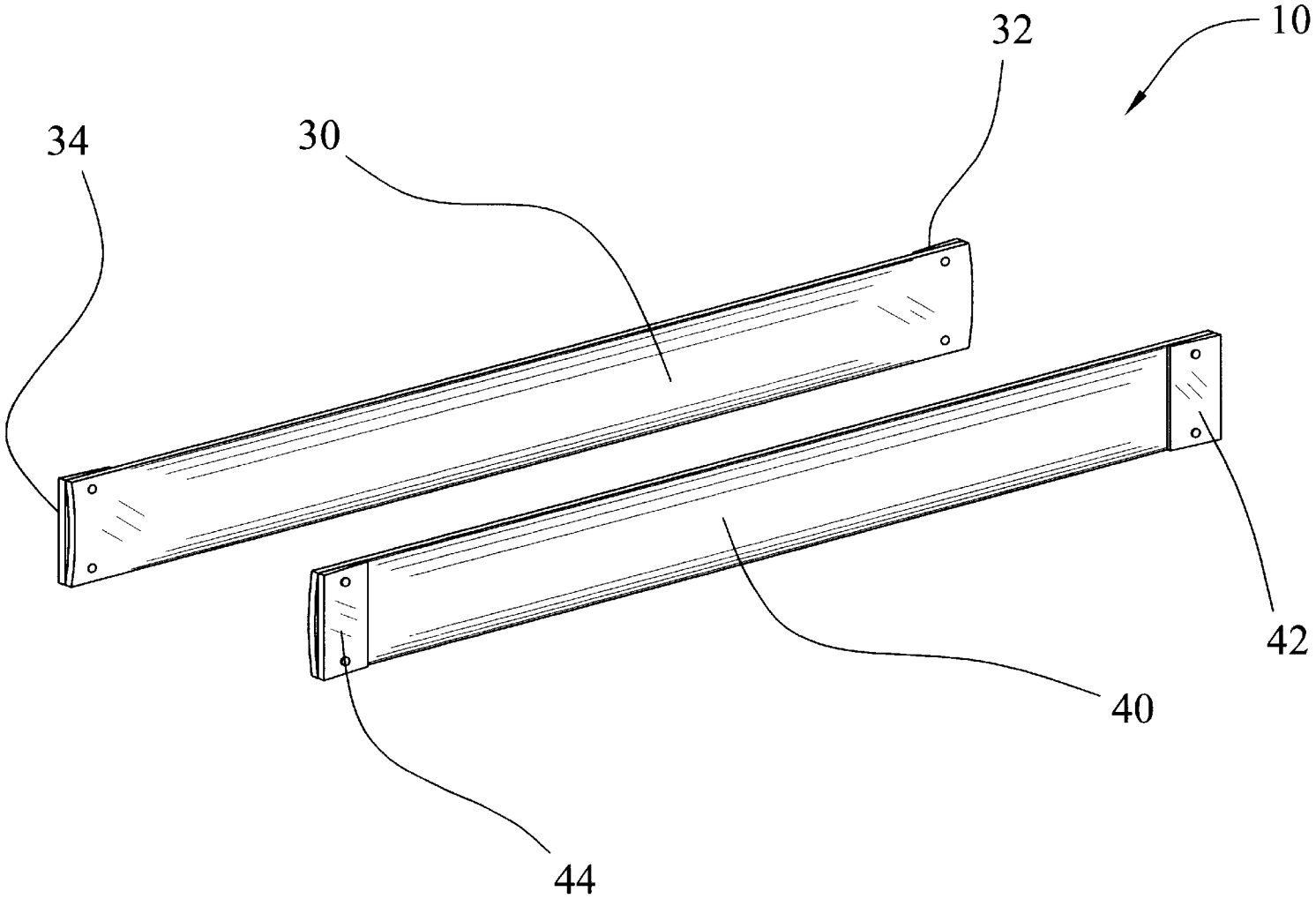
FIG. 7 is an upper perspective view of the band members.

The first band 30 is comprised of an elongate structure that is formed into a straight structure as shown in FIG. 7 of the drawings. The first band 30 is comprised of a resilient material and structure to allow for bending of the first band 30 and allowing the first band 30 to return to its original straight structure.

The first band 30 is preferably comprised of a resilient material having an arcuate cross section providing increased rigidity to the first band 30 when in a straight condition and reduced rigidity when in a bent condition as best illustrated in FIGS. 4 through 7 of the drawings. The functionality of the first band 30 is similar to the function of an elongate tape within a conventional retractable tape measure. The material utilized to construct the first band 30 may be comprised of steel, spring steel, plastic, plastic alloy, bimetal, composite material or other material having a resilient characteristic. The applicant has found the usage of spring steel desirable because of the significant rigidity provided when the first band 30 is in a straight condition and the extended life of spring steel.

Figure 5:
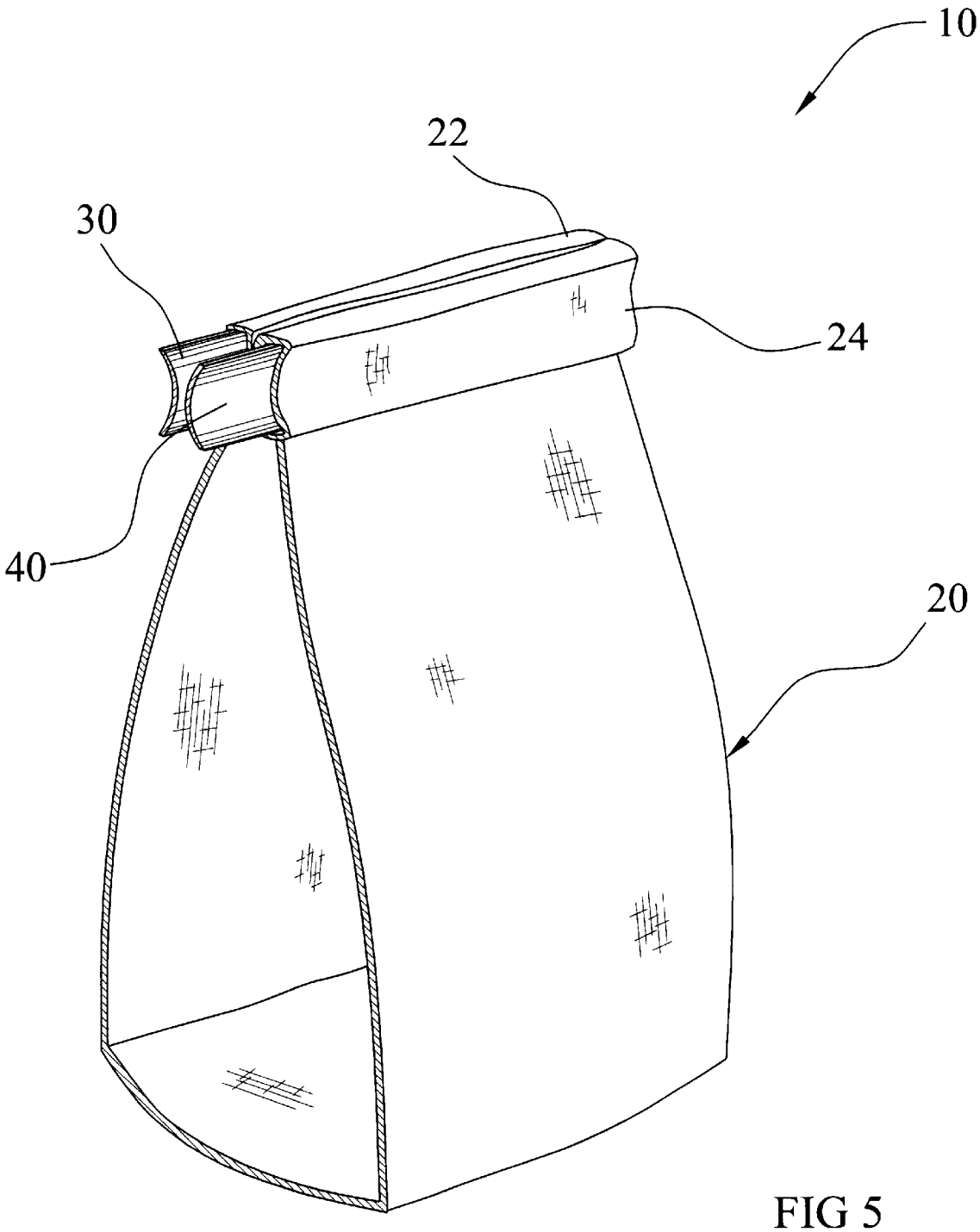
FIG. 5 is an upper perspective cutaway view of the present invention in the closed position.
Figure 6:
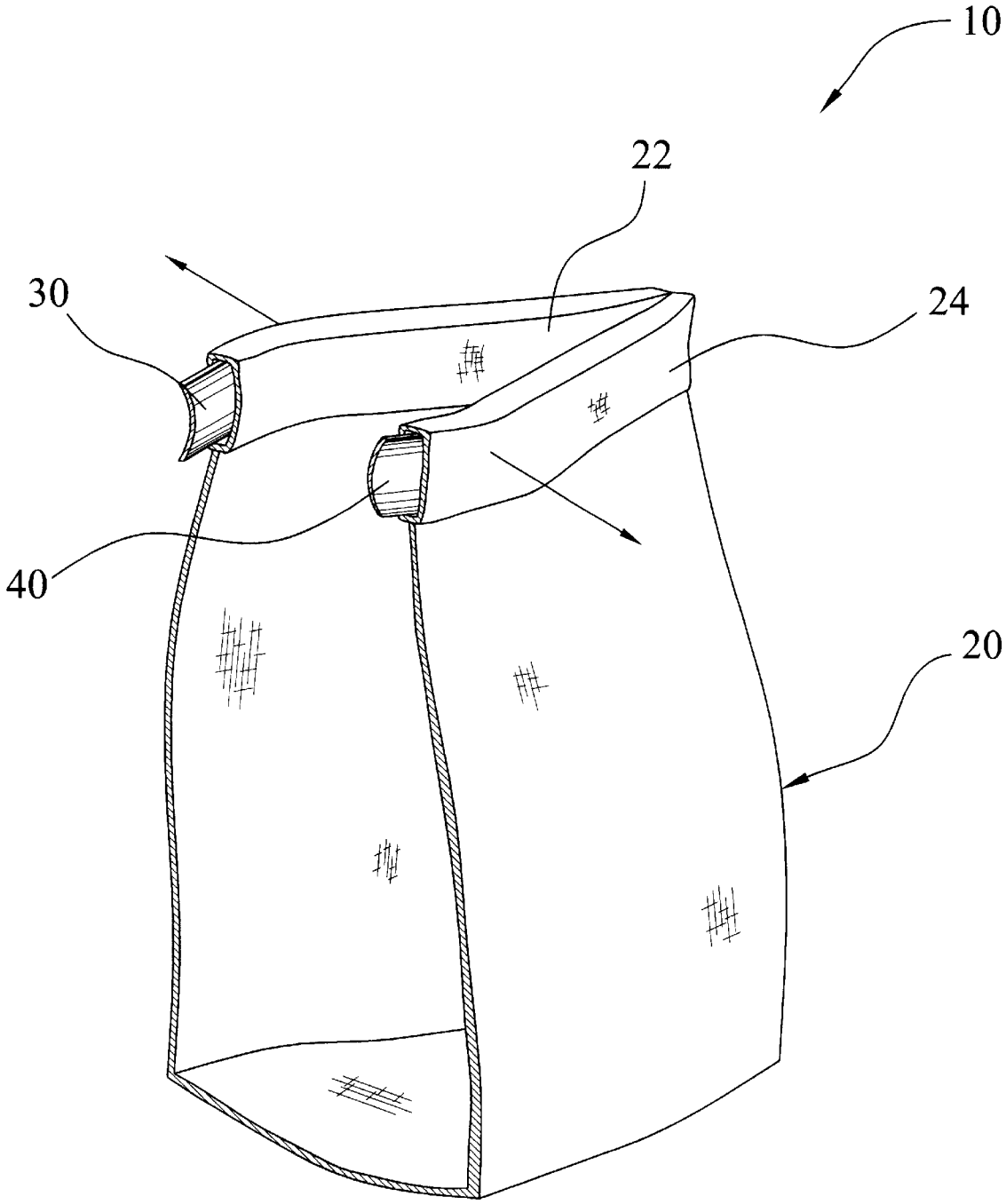
FIG. 6 is an upper perspective cutaway view of the present invention in the open position.

As best shown in FIGS. 5 and 6 of the drawings, the first band 30 has an arcuate cross section which provides rigidity when straight and reduced rigidity upon bending of a portion of the first band 30. The curvature of the first band 30 may vary depending upon the desired characteristics of the first band 30. The length of the first band 30 may also vary depending upon the application of the present invention and the opening required to be closed.

A first member 32 and a second member 34 are preferably attached to the opposing ends of the first band 30 for preventing wearing of the ends of the first band 30 through the material of the bag device 20. The members 32, 34 are preferably attached to the concave surface and the distal portions of the first band 30. The members 32, 34 extend a finite distance along the first band 30 and preferably are tapered from the outer portion to the inner portion thereof.

Figure 4:
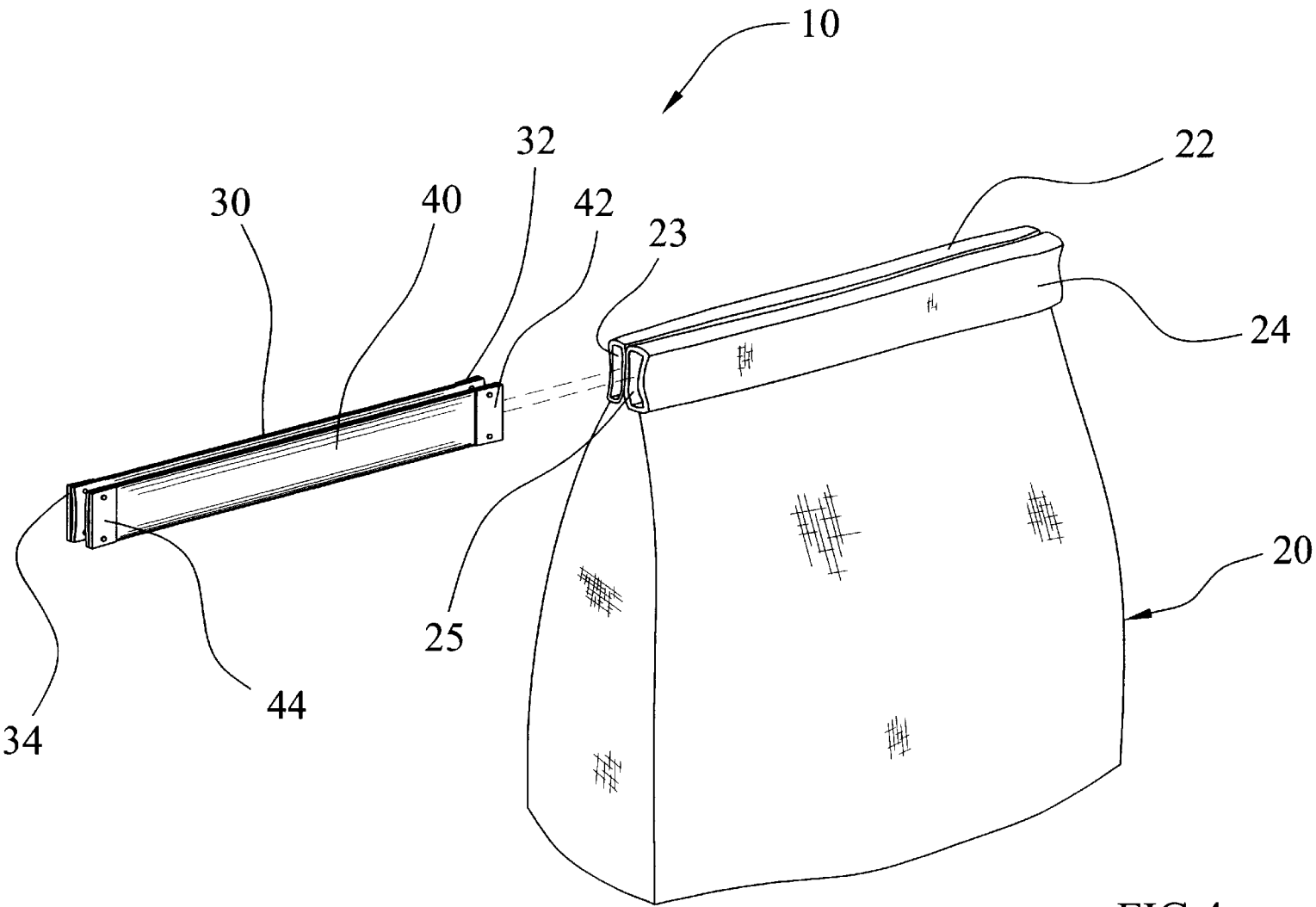
FIG. 4 is an exploded upper perspective view of the present invention.

The first band 30 is positioned within a channel within the first lip 22 of the bag device 20 as best illustrated in FIGS. 4 through 6 of the drawings. The first lip 22 is preferably secured at each opposing end thereof by sewing, staple, adhesive or other securing means thereby preventing removal of the first band 30 from the first lip 22. The channel within the first lip 22 is preferably formed for snugly receiving the first band 30, however various sizes and shapes of channels may be utilized within the first lip 22.

The second band 40 is comprised of an elongate structure that is formed into a straight structure similar to the first band 30 as shown in FIG. 7 of the drawings.

The second band 40 is comprised of a resilient material and structure to allow for bending of the second band 40 and allowing the second band 40 to return to its original straight structure. The second band 40 is preferably comprised of a similar structure and material as the first band 30 as further shown in FIG. 7 of the drawings, however variations between the bands 30, 40 may exist for various purposes.

The second band 40 is preferably comprised of a resilient material having an arcuate cross section providing increased rigidity to the second band 40 when in a straight condition and reduced rigidity when in a bent condition as best illustrated in FIGS. 4 through 7 of the drawings. The functionality of the second band 40 is similar to the function of an elongate tape within a conventional retractable tape measure. The material utilized to construct the second band 40 may be comprised of steel, spring steel, plastic, plastic alloy, bimetal, composite material or other material having a resilient characteristic. The applicant has found the usage of spring steel desirable because of the significant rigidity provided when the second band 40 is in a straight condition and the extended life of spring steel.

As best shown in FIGS. 5 and 6 of the drawings, the second band 40 has an arcuate cross section which provides rigidity when straight and reduced rigidity upon bending of a portion of the second band 40. The curvature of the second band 40 may vary depending upon the desired characteristics of the second band 40. The length of the second band 40 may also vary depending upon the application of the present invention and the opening required to be closed.

Figure 2:
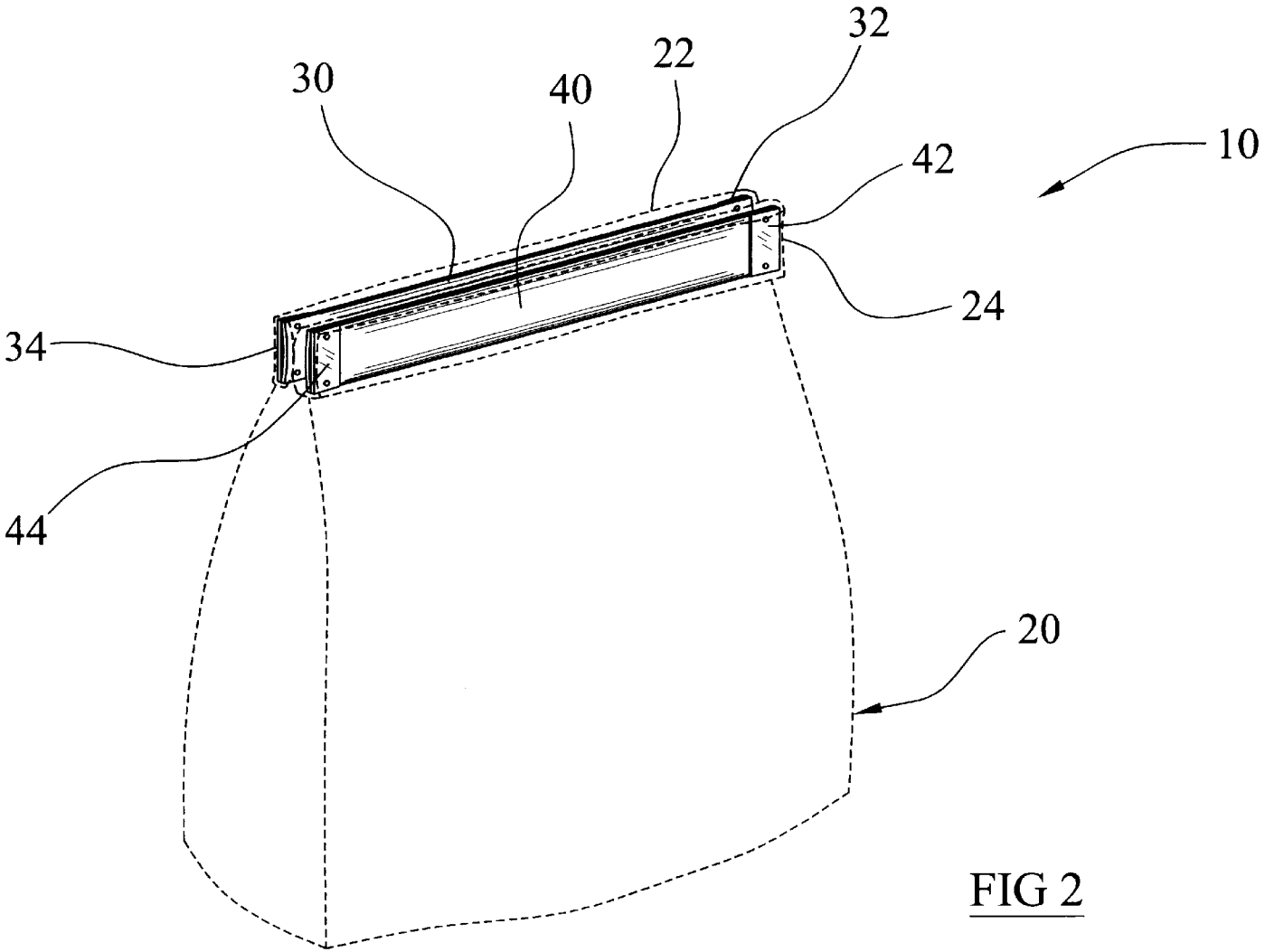
FIG. 2 is an upper perspective view of the present invention in the closed position.

The second band 40 and the first band 30 may be comprised of various sizes, lengths, heights, thickness, materials, shapes, cross sections and weights to customize the required closure action of the particular application. It can be appreciated that more than two bands 30, 40 may be utilized in conjunction together such as but not limited to within a multi-parallel band structure. In addition, the bands 30, 40 are preferably not connected to one another directly other than by the interconnection of the lips 22, 24 of the bag device 20 which allows for the opening of one band 30, 40 without significant affecting the physical state of the opposing band 30, 40. However, the bands 30, 40 are maintained preferably substantially parallel and adjacent to one another to provide a secure closure of the opening within the bag device 20 as shown in FIGS. 1 and 2 of the drawings.

The convex surfaces of the bands 30, 40 are preferably in opposition to one another as best shown in FIGS. 4 through 7 of the drawings. The breaking movement of each of the bands 30, 40 is an outward movement as shown in FIG. 6 of the drawings.

A first member 42 and a second member 44 are preferably attached to the opposing ends of the second band 40 for preventing wearing of the ends of the second band 40 through the material of the bag device 20. The members 42, 44 are preferably attached to the concave surface and the distal portions of the second band 40. The members 42, 44 extend a finite distance along the second band 40 and preferably are tapered from the outer portion to the inner portion thereof.

The members 42, 44 preferably flatten the distal portions of the bands 30, 40 and are secured via conventional fastener system such as but not limited to fasteners, rivets, welding or adhesive. The flattened portion of the bands 30, 40 increases the visual appearance of the bag device 20 and reduces potential wearing of the material. The members 42, 44 further create a blunted end for the bands 30, 40 which reduces sharpness of the ends of the bands 30, 40 to a user.

The second band 40 is positioned within a channel within the second lip 24 of the bag device 20 as best illustrated in FIGS. 4 through 6 of the drawings. The second lip 24 is preferably secured at each opposing end thereof by sewing, staple, adhesive or other securing means thereby preventing removal of the second band 40 from the second lip 24. The channel within the second lip 24 is preferably formed for snugly receiving the second band 40, however various sizes and shapes of channels may be utilized within the second lip 24. The opposing ends of the second lip 24 are attached to the corresponding opposing ends of the first lip 22 to form the opening within the bag device 20 or similar article as best shown in FIG. 1 of the drawings.

In addition, an additional layer of textile or other suitable material may be positioned within the interior channel of the lips 22, 24 to prevent damage by the bands 30, 40. The additional layer may be directly attached to the bands 30, 40 or directly to the interior channels of the lips 22, 24.

Figure 3:
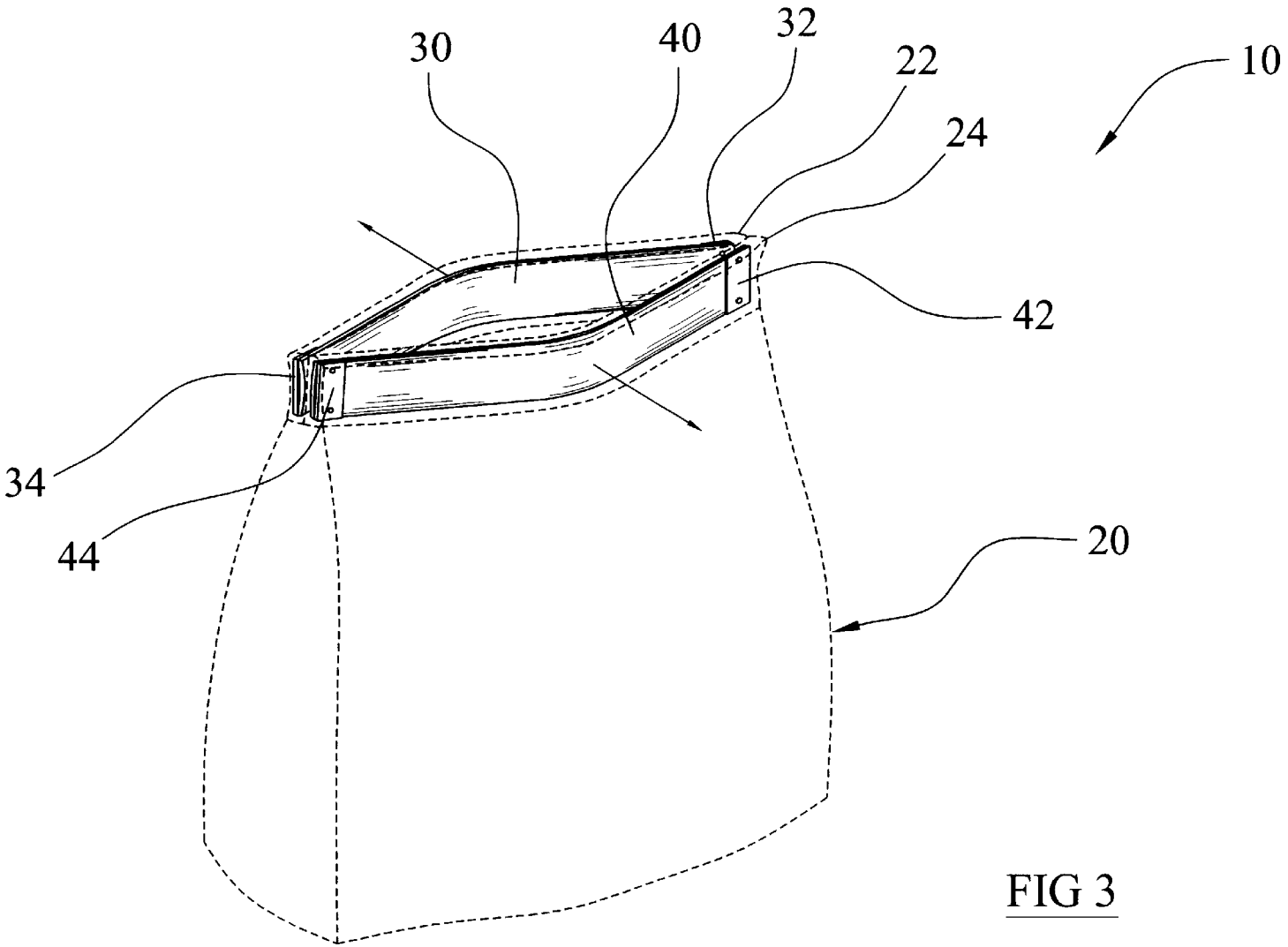
FIG. 3 is an upper perspective view of the present invention in the open position.

In use, the bands 30, 40 are maintained in their natural straight and rigid structure for maintaining the opening of the bag device 20 in a closed position as shown in FIGS. 1, 2 and 5 of the drawings. When the user desires to access the interior contents of the bag device 20, the user grasps one or more of the lips 22, 24 and draws the same outwardly thereby causing the corresponding band 30, 40 to bend which results in the rigid straight structure being reduced to a flexible curved structure which places the opening within an open position. When straight structure of one of the bands 30, 40 is bent to a point wherein a cross section of a portion of the band 30, 40 becomes relatively straight, an audible "snapping" sound is emitted along with the band 30, 40 become relatively flexible almost instantaneously as shown in FIGS. 3 and 6 of the drawings. When the user is finished accessing the interior of the bag device 20, the user then releases the lip which allows for the bands 30, 40 to automatically return to a normal straight and rigid structure as shown in FIGS. 1, 2 and 5 of the drawings. Because the bands 30, 40 are not interconnected directly to one another, one or more of the bands 30, 40 may be individually bent depending upon the requirements of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A closure apparatus for an article having an opening with a first lip and a second lip interconnected to one another, said closure apparatus comprising:

a first band positioned within said first lip;

a second band positioned within said second lip substantially parallel to said first band, wherein said second band is not connected to said first band; and wherein said bands are each comprised of a resilient material having an arcuate cross section, and wherein said bands have a rigid straight condition and a flexible bent condition.

2. The closure apparatus of claim 1, wherein said bands emit an audible sound when transitioning from said rigid straight condition to said flexible bent condition.

3. The closure apparatus of claim 1, wherein said bands provide a tactile indication when transitioning from said rigid straight condition to said flexible bent condition.

4. The closure apparatus of claim 1, wherein said bands emit an audible sound when transitioning from said flexible bent condition to said rigid straight condition.

5. The closure apparatus of claim 1, wherein said bands provide a tactile indication when transitioning from said flexible bent condition to said rigid straight condition.

6. The closure apparatus of claim 1, wherein said bands are comprised of a spring steel material.

7. The closure apparatus of claim 1, wherein said bands are comprised of a plastic material.

8. The closure apparatus of claim 1, wherein said bands are comprised of a composite material.

9. The closure apparatus of claim 1, wherein said bands are positioned with respective convex surfaces in opposition to one another.

10. The closure apparatus of claim 1, wherein said bands are shorter in length than said lips.

11. A closure apparatus for an article having an opening with a first lip and a second lip interconnected to one another, said closure apparatus comprising:

a first band positioned within said first lip;

a second band positioned within said second lip substantially parallel to said first band, wherein said second band is not connected to said first band;

a first member and a second member attached to distal ends of said first band;

a third member and a fourth member attached to distal ends of said second band; and wherein said bands are each comprised of a resilient material having an arcuate cross section, and wherein said bands have a rigid straight condition and a flexible bent condition.

12. The closure apparatus of claim 11, wherein said bands emit an audible sound when transitioning from said rigid straight condition to said flexible bent condition.

13. The closure apparatus of claim 11, wherein said bands provide a tactile indication when transitioning from said rigid straight condition to said flexible bent condition.

14. The closure apparatus of claim 11, wherein said bands emit an audible sound when transitioning from said flexible bent condition to said rigid straight condition.

15. The closure apparatus of claim 11, wherein said bands provide a tactile indication when transitioning from said flexible bent condition to said rigid straight condition.

16. The closure apparatus of claim 11, wherein said bands are comprised of a spring steel material.

17. The closure apparatus of claim 11, wherein said bands are comprised of a plastic material.

18. The closure apparatus of claim 11, wherein said bands are comprised of a composite material.

19. The closure apparatus of claim 11, wherein said bands are positioned with respective convex surfaces in opposition to one another.

20. A method of operating a closure apparatus for an article having an opening with a first lip and a second lip interconnected to one another, said closure apparatus comprising a first band positioned within said first lip, a second band positioned within said second lip substantially parallel to said first band, wherein said second band is not connected to said first band, and wherein said bands are each comprised of a resilient material having an arcuate cross section, and wherein said bands have a rigid straight condition and a flexible bent condition, said method comprising the steps of:

(a) engaging at least one of said bands outwardly away from an opposite band thereby placing said closure apparatus in an open state; and (b) releasing said at least one of said bands thereby allowing said closure apparatus to automatically return to a closed state.

* * * * *